US006696137B2

(12) United States Patent
Yong

(10) Patent No.: US 6,696,137 B2
(45) Date of Patent: Feb. 24, 2004

(54) WOVEN AND PACKED COMPOSITE CONSTRUCTIONS

(75) Inventor: Zhou Yong, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/353,315

(22) Filed: Jan. 28, 2003

(65) Prior Publication Data

US 2003/0113560 A1 Jun. 19, 2003

Related U.S. Application Data

(60) Division of application No. 09/571,636, filed on May 15, 2000, now abandoned, which is a continuation-in-part of application No. 08/903,668, filed on Jul. 31, 1997, now Pat. No. 6,063,502.

(51) Int. Cl.[7] ..... B32B 3/00; D03D 15/00; E21B 10/46; E21B 10/08

(52) U.S. Cl. ..... 428/175; 428/698; 428/408; 428/469; 428/196; 175/425; 175/426; 175/434

(58) Field of Search ..... 428/469, 175, 428/698, 196, 408; 175/425, 426, 434

(56) References Cited

U.S. PATENT DOCUMENTS

| | | | | |
|---|---|---|---|---|
| 4,255,165 | A | * | 3/1981 | Dennis et al. |
| 4,341,577 | A | * | 7/1982 | Vandenburgh |
| 4,378,975 | A | * | 4/1983 | Tomlinson |
| 4,428,906 | A | * | 1/1984 | Rozmus |
| 4,604,106 | A | * | 8/1986 | Hall |
| 4,656,002 | A | * | 4/1987 | Lizenby et al. |
| 4,694,918 | A | * | 9/1987 | Hall |
| 4,744,943 | A | * | 5/1988 | Timm |

(List continued on next page.)

FOREIGN PATENT DOCUMENTS

| | | | |
|---|---|---|---|
| EP | 0 278 793 | * | 8/1988 |
| GB | 1572460 | * | 7/1980 |
| GB | 2315775 | * | 11/1998 |

*Primary Examiner*—John J. Zimmerman
*Assistant Examiner*—Jason L Savage
(74) *Attorney, Agent, or Firm*—Jeffer, Mangels, Butler & Marmaro

(57) ABSTRACT

PCD and PCBN composite constructions have an ordered structure of two or more material phases that are combined together in a packed or interwoven configuration. One of the material phases is formed from materials selected from the group consisting of: polycrystalline diamond, polycrystalline cubic boron nitride; carbides, borides, nitrides, and carbonitrides from groups IVA, VA, and VIA of the Periodic Table; and mixtures thereof. Another material phase is preferably formed from a material having a degree of ductility that is higher than that of the first material phase. Example second material phase materials include those selected from the group consisting of cermets, Co, Ni, Fe, W, Mo, Cu, Al, Nb, Ti, Ta, and mixtures thereof. Example composite constructions include those having: (1) a first material phase formed from WC—Co, and a second material phase formed from Co; (2) a first material phase is selected from the group consisting of polycrystalline diamond, polycrystalline cubic boron nitride, and mixtures thereof, and a second material phase being a cermet material; and (3) a first material phase formed from polycrystalline diamond and a second material phase formed from WC—Co. Alternatively, the material phases can be formed from the same materials, only in different proportions. Woven or packed composite constructions have surface structures formed from a number of the order material phases (made from the same, similar, or different materials) that are specifically engineered (in terms of geometry, arrangement, and materials) to provide optimized, rather than compromised, performance properties.

31 Claims, 8 Drawing Sheets

U.S. PATENT DOCUMENTS 4,772,524 A * 9/1988 Coblenz
4,866,885 A * 9/1989 Dodsworth
4,945,073 A * 7/1990 Dubensky et al. ..... 501/93
5,271,749 A * 12/1993 Rai et al. ..... 51/293
5,290,507 A * 3/1994 Runkle ..... 419/14
5,419,868 A * 5/1995 Honnorat ..... 419/4
5,441,817 A * 8/1995 Rai ..... 428/551
5,492,186 A * 2/1996 Overstreet et al. ..... 175/374
5,598,621 A * 2/1997 Littecke et al. ..... 29/412
5,645,781 A * 7/1997 Popovic' et al. ..... 264/639
5,676,496 A * 10/1997 Littecke et al. ..... 407/118
5,712,030 A * 1/1998 Goto et al. ..... 428/332
6,187,068 B1 * 2/2001 Frushour et al. ..... 51/295
6,258,139 B1 * 7/2001 Jensen ..... 51/307
6,325,165 B1 * 12/2001 Eyre ..... 175/426

* cited by examiner

FIG. 11
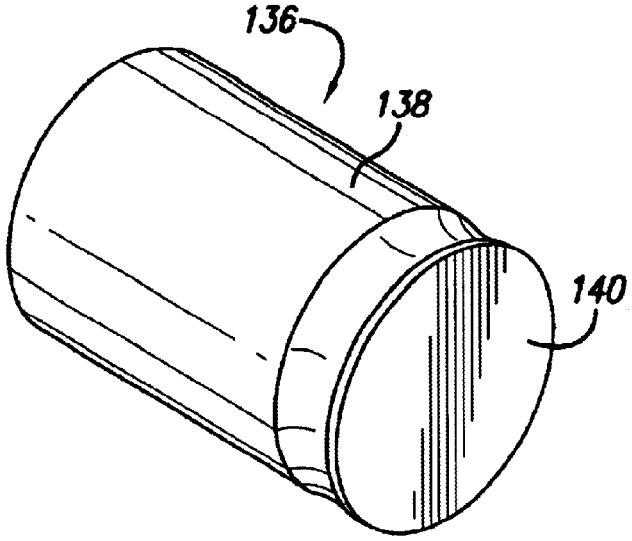
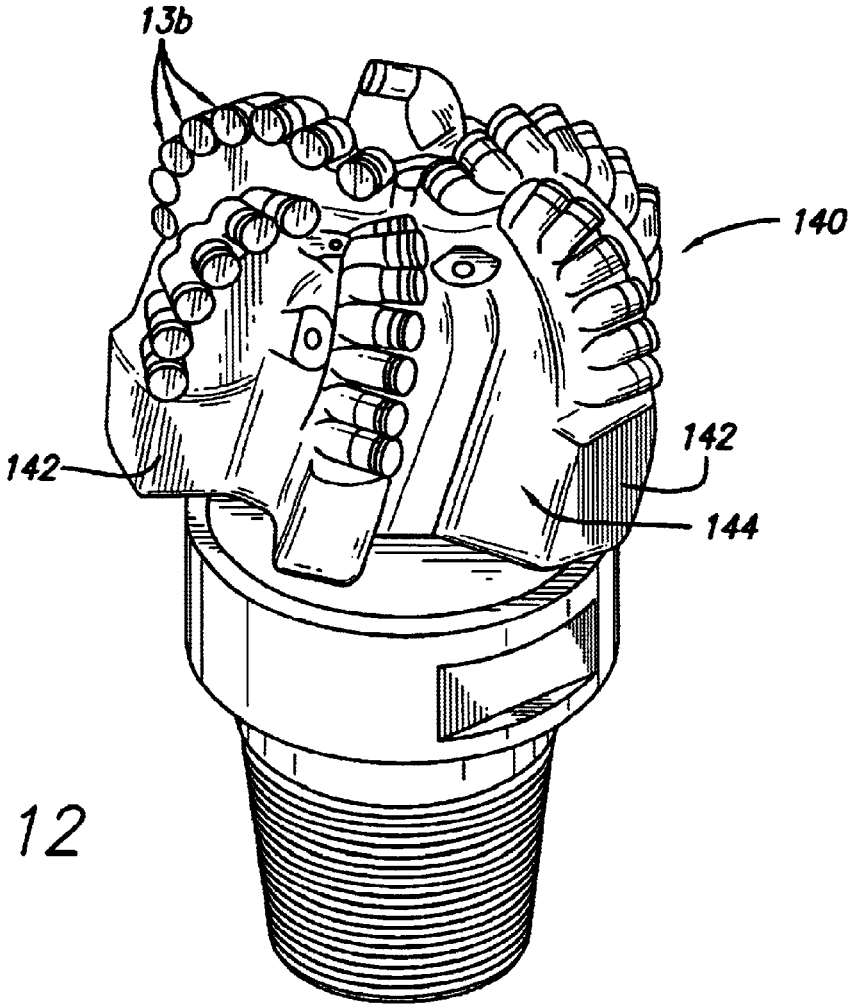
FIG. 12

WOVEN AND PACKED COMPOSITE CONSTRUCTIONS

CROSS REFERENCE TO RELATED APPLICATIONS

This patent application is a divisional of U.S. patent application Ser. No. 09/571,636, filed on May 15, 2000 now abandoned, which is a continuation-in-part of U.S. patent application Ser. No. 08/903,668, filed on Jul. 31, 1997, now U.S. Pat. No. 6,063,502.

FIELD OF THE INVENTION

This invention relates generally to composite constructions comprising a hard material phase and a relatively softer ductile material phase and, more particularly, to composite constructions having ordered micro and macrostructures of polycrystalline diamond and a relatively softer ductile material to provide improved mechanical and/or thermal properties, when compared to traditional constructions formed from polycrystalline diamond alone.

BACKGROUND OF THE INVENTION

Polycrystalline diamond (FCD) and polycrystalline cubic boron nitride (PCBN) constructions, synthesized by high temperature/high pressure processes, are well known for their mechanical properties of hardness and wear resistance, making them a popular material choice for use in such industrial applications as cutting tools for machining, mining and drilling where such mechanical properties are highly desired. For example, PCD and PCBN constructions are provided in the form of surface coatings on, e.g., inserts and shear cutters used with cutting and drilling tools to impart properties of hardness and wear resistance thereto.

Traditionally, such PCD and PCBN inserts and shear cutters are formed by coating a carbide substrate with one or more layers of PCD or PCBN. Such inserts and shear cutters comprise a substrate, a surface layer, and often transition layers to improve the bonding between the coating and the substrate. The substrate is, most preferably, a carbide substrate, e.g., cemented carbide, tungsten carbide (WC) cemented with cobalt (WC—Co). The coated layer or layers of PCD conventionally comprises a binder metal content from 10% to 30% by weight to facilitate intercrystalline bonding and bonding of the layers to each other and to the underlying substrate.

Binder metals used to form PCD include cobalt, iron, nickel and/or mixtures or alloys thereof, and can include other metals such as manganese, tantalum, chromium and/or mixtures or alloys thereof. However, while higher metal content typically increases toughness, higher metal content also decreases hardness, thereby limiting the flexibility of providing coatings with the requisite properties. Additionally, when variables are selected to increase hardness, typically brittleness also increases, thereby reducing the toughness of the cutting element.

Generally, PCD and PCBN each exhibit extremely high hardness and provide a high degree of wear protection to a cutting element. However, in more complex wear environments causing impact and fretting, layers comprising PCD and PCBN are known to fail by gross chipping and spalling. For example, inserts coated with a PCD monolayer are known to exhibit brittleness that causes substantial problems in practical applications. Conventional methods of improving the performance of PCD or PCBN layers include controlling particle size to maximize toughness, but the effect is limited.

It is, therefore, desired that PCD and PCBN composite constructions be provided that are specifically designed to have improved properties of fracture toughness, impact resistance and/or fatigue life when compared to conventional PCD and PCBN constructions, thereby reducing the potential for conventional PCD and PCBN failure modes of spalling and/or chipping. It is desirable that PCD and PCBN composite constructions have such properties of improved fracture toughness, impact resistance and/or fatigue life without sacrificing other desirable properties of wear resistance and hardness associated with the PCD and PCBN materials. It is desired that such composite constructions be adapted for use in such applications as cutting tools, roller cone bits, hammer bits, drag bits and other mining, construction and machine applications where properties of improved fracture toughness, impact resistance and/or fatigue life is desired.

SUMMARY OF THE INVENTION

PCD and PCBN composite constructions of this invention have an ordered structure of two or more material phases that are combined together in a packed or woven configuration to provide improved properties of fracture toughness, impact resistance and/or fatigue life when compared to conventional PCD and PCBN constructions. Specifically, composite constructions of this invention have a structure of two or more different material phases that are interwoven or that are packed together.

In an example embodiment, one of the material phases is formed from materials selected from the group consisting of: polycrystalline diamond, polycrystalline cubic boron nitride; carbides, borides, nitrides, and carbonitrides from groups IVA, VA, and VIA of the Periodic Table; and mixtures thereof. Another of the material phases can be formed from a material having a degree of ductility that is higher than that of the first material phase. Example second material phase materials include those selected from the group consisting of cermets, Co, Ni, Fe, W, Mo, Cu, Al, Nb, Ti, Ta, and mixtures thereof.

Preferred embodiments of composite constructions of this invention comprise: (1) a first material phase formed from WC—Co, and a second material phase formed from Co; (2) a first material phase is selected from the group consisting of polycrystalline diamond, polycrystalline cubic boron nitride, and mixtures thereof, and a second material phase being a cermet material; and more preferably (3) a first material phase formed from polycrystalline diamond and a second material phase formed from WC—Co. Alternatively, the material phases can be formed from the same types of materials, differing in the proportion of the material used in each material phase.

Woven or packed composite constructions of this invention have surface structures formed from a number of the order material phases (made from the same, similar, or different materials) that are specifically engineered (in terms of geometry, arrangement, and materials) to provide optimized desired performance properties. This is a significant improvement over conventional PCD or PCBD compositions, not having a surface structure configuration of ordered material phases, that provide relatively limited performance properties due to the compromise inherent in the materials and manner of construction.

BRIEF DESCRIPTION OF THE DRAWINGS

These and other features and advantages of the present invention will become appreciated as the same becomes better understood with reference to the specification, claims and drawings wherein:

FIG. 11 is a schematic perspective side view of a shear cutter comprising a substrate and/or cutting surface formed from a PCD composite construction of this invention; and FIG. 12 is a perspective side view of a drag bit comprising a number of the shear cutters of FIG. 11.

DETAILED DESCRIPTION OF THE INVENTION

Composite constructions, prepared according to the principles of this invention, have an ordered structure made up of multiple woven or packed material phases. The material phases can be the same or different, and each material phase can be formed from a single type of material, or can be formed from two or more materials. Composite constructions formed in this manner, comprising polycrystalline diamond (PCD) material phases, are engineered to provide one or more desired properties of fracture toughness, impact resistance, fatigue life, hardness, and wear resistance that exceed those provided from conventional PCD constructions for use in aggressive applications, such as subterranean cutting and drilling applications.

Figure 1:
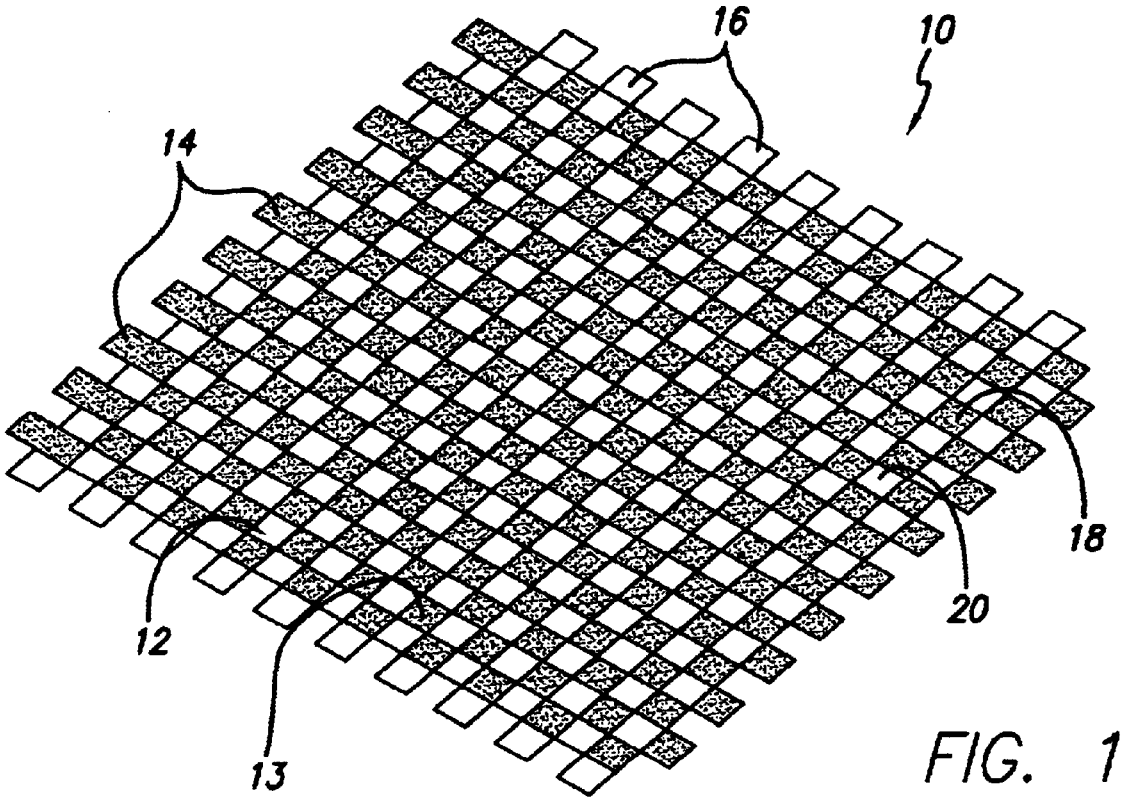
FIG. 1 is a schematic view of an example woven composite construction of this invention.
Figure 2:
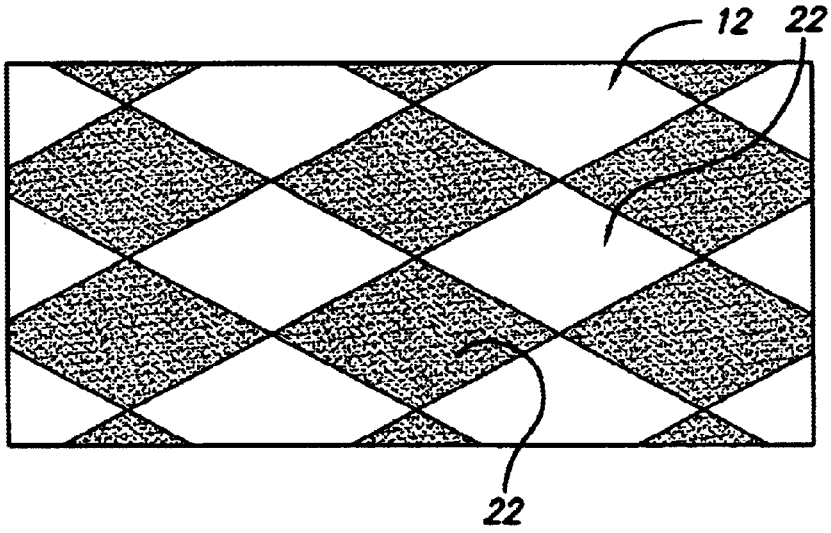
FIG. 2 is an enlarged view of a section of the composite construction of FIG. 1.

FIG. 1 illustrates a first example composite construction 10 of this invention having a structure 12 that is generally made up of two or more woven material phases. In the illustrated example embodiment, the composite construction has a structure 12 made up of interwoven first material phases 14 and second material phases 16, that together form a repeating pattern of first material sections 18 and second material sections 20 dispersed throughout the structure. As best seen in FIG. 2, the structure 12 also comprises a plurality of layered sections 22, where the first and second material phases are placed over or under one another, repeated throughout the structure as a result of the interwoven material phases.

The example composite construction 10 is shown in FIG. 1 as having two material phases 14 and 16 for purposes of simplicity for referencing the woven nature of the structure. It is, however, to be understood that composite constructions of this invention can be formed from a single-type of material phase, i.e., where each material phase is made from the same material, or from different types of material phases, i.e., where two or more material phases are formed from different types of materials, depending on the particular composite construction application.

In an example embodiment, useful for forming a wear surface on a drilling or cutting element used for subterranean drilling operations, it is desired that the composite construction comprise a first material phase formed from a hard material, and a second material phase formed from a relatively softer or more ductile material. Example materials useful for forming the first material phase include cermet materials such as carbides, borides, nitrides, carbonitrides of the group IVa, Va, and VIa metals and metal alloys of the Periodic Table. Example cermet materials include: WC—M, TiC—M, TaC—M, VC—M, and $Cr_3C_2$—M, where M is a metal such as Co, Ni, Fe, or alloys thereof. A preferred cermet material is WC—Co. Additionally, the first material phase can be formed from PCD, polycrystalline cubic boron nitride (PCBN), and mixtures of PCD and PCBN with carbides, borides and nitrides of the group IVa, Va, and VIa metals and metal alloys of the Periodic Table. The two material phases are considered different from each other in such that they have different metallurgical properties and/or physical properties and/or mechanical properties. For example, in a two-material phase structure, both may contain diamond and cobalt, but have different amounts of cobalt or different diamond grain sizes, therefore being different materials. Composite constructions of this invention having a PCD material phase are highly desirable for use in applications where, because of the aggressive working environment, properties of hardness and wear resistance are important. PCD, PCBN, and mixtures thereof can be prepared according to the process described in U.S. Pat. Nos. 4,604,106; 4,694,918; 5,441,817; and 5,271,749 that are each incorporated herein by reference, starting with diamond or cubic boron nitride (cBN) powder and wax.

Example materials useful for forming the second material phase includes those materials having a degree of ductility greater than that of the material selected to form the first material phase. For example, in the event that the first material phase is formed from a cermet material, the second material phase can be formed from the group of materials such as Group IVa, Va, and VIa ductile metals and metal alloys including, but not limited to Fe, Ni, Co, Cu, Ti, Al, Ta, Mo, Nb, W, and their alloys. In the event that the first material phase is formed from PCD or PCBN, the second material phase can be formed from the group of materials including carbides, borides, nitrides, and carbonitrides of the group IVa, Va, and VIa metals and metal alloys of the Periodic Table. In an example embodiment where the first material phase is PCD or PCBN, a preferred second material phase is WC—Co.

The materials presented above have been identified as being useful for forming first or second material phases for purposes of simplicity and reference. It is to be understood that the same groups of materials can be used to form other material phases in the event that the composite construction woven structure is formed from more than two different material phases.

The material phases used to make woven composite constructions of this invention can additionally itself comprise a structure made up of two or more different material regions. In this sense, woven composite constructions of this invention comprising such a material phase can be thought of as having a microstructure within a macrostructure. Wherein the composite construction macrostructure is formed from woven material phases, and at least one of the woven material phases itself comprises a material microstructure. Further, a material phase comprising two or more materials can have an ordered or random microstructure. An example material phase having a random microstructure is one comprising a plurality of first regions (e.g., a hard regions formed from WC—Co or PCD) that are randomly dispersed within a substantially continuous second region (e.g., a matrix of a relatively softer material formed from Co or WC—Co), such as that disclosed in U.S. Pat. No. 5,880,382, which is incorporated herein by reference. An example material phase having an ordered microstructure is one comprising an ordered arrangement of first regions (e.g., hard phase regions formed from WC—Co or PCD) substantially surrounded by second regions (e.g., Co or PCD), such as that disclosed in U.S. patent application Ser. No. 08/903,668, which is incorporated herein by reference.

Figure 4:
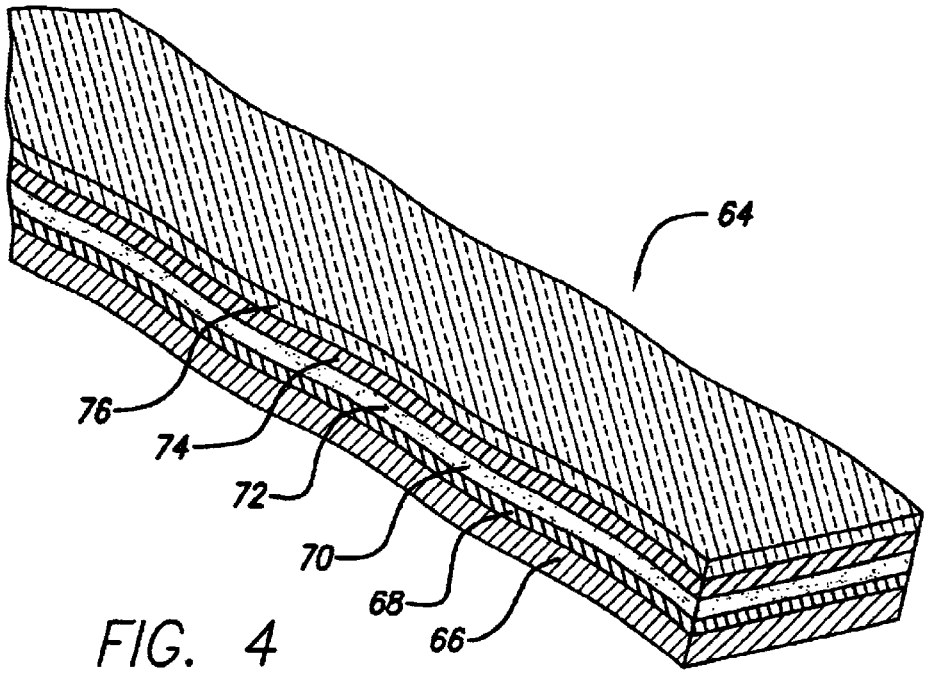
FIG. 4 is an enlarged view of an example laminate construction used to form composite constructions of this invention.

Additionally, one or more material phases used to form woven composite constructions of this invention can have a laminate construction comprising layers of different material as shown in FIG. 4. For example, a material phase can comprise two of more different material layers that are arranged on top of one another so that a surface portion of the material phase comprises a single material with one or more underlying material layers. Alternatively, a material phase can comprise two of more different material layers that are arranged side-by-side of one another so that a surface portion of the material phase comprise two or more material layers. This side-by-side material phase embodiment can be formed, for example, by slicing off a side portion of the tape illustrated in FIG. 4 and laying the sliced-off portion sideways to form the material phase (as shown for example in FIG. 5).

In an example composite construction embodiment, the first material phase 14 is formed from a hard material such as PCD, and the second material phase 16 is formed from a material having a higher degree of ductility such as WC—Co. The repeated hard and ductile material phase sections 18 and 20 of the composite structure provide combined and controlled or engineered properties of impact resistance and fracture toughness (associated with the ductile material phase sections), with hardness and wear resistance (associated with the hard material phase sections).

Because of the interwoven nature of the material phases, each first and second material phase section 18 and 20 is surrounded about four sides by another first and second material section. In the example composite construction embodiment illustrated in FIG. 1, each first material phase section 18 is surrounded along its four sides by a second material phase section 18 in a checkerboard fashion. When the first material phase section 18 is PCD or WC—Co, and the second material phase section 20 is formed from a tougher material such as WC—Co or Co, respectively, the placement of the second material phase section along each side of the first material phase section serves to absorb impact energy, thereby preventing cracks from initiating or in the case where cracks are present, preventing propagation through the composite structure. Thus, woven PCD composite constructions of this invention provide improved properties of impact resistance, fracture toughness and/or fatigue life when compared to conventional PCD materials.

Additionally, the layered sections 22 of the composite structure, formed from the interwoven first and second material phases, provide compounded, extended, or sequential performance properties thereto, depending on the types of materials that are used to form the material phases. Generally, the layered sections 22 can serve to extend the duration of a desired performance property, e.g., when the layer sections are formed from identical or similar first and second material phases, or can serve to provide compounded or sequential performance properties, e.g., when the layer sections are formed from different first and second material phases.

In the example composite construction discussed above (where the first material phase section 18 is PCD or WC—Co, and the second material phase section 20 is formed from a more ductile material such as WC—Co or Co, respectively), the layered sections provide both compounded and sequential properties of impact resistance and hardness/wear resistance. A layered section with the first material phase over the second material phase provides compounded performance properties of hardness with an enhanced degree of impact resistance when compared to other nonlayered first material phase sections. The property of enhanced impact resistance results from the additional placement of the second material phase under the first material phase in addition to surrounding its four sides, further serving to control crack initiation and/or propagation through the structure. A layered section with the second material phase over the first material phase provides sequential performance properties of impact resistance initially, which gives away to wear resistance and hardness when the first material phase is exposed.

The presence of the layered sections, therefore, provides a composite construction structure comprising a working surface that can vary from its initial makeup depending on the working environment. For example, a composite construction exposed to a severely abrasive working environment may comprise a predominant amount of material phase sections that are formed from a hard material, i.e., after the soft material phases wear away. A composite construction exposed to a high impact working environment may comprise a predominant amount of material phase sections that are formed from a soft material, i.e., after the hard material phases fail.

In addition to the features discussed above, woven composite constructions of this invention have a strength-enhanced structure due to the use of continuous, rather than noncontinuous, alternating material phases. Although the material phases form material phase sections that are distinct along the surface of the composite structure, each material phase is continuous, thereby enhancing the strength of the structure. When looking at Hertzian tensile stresses, the continuous material phases in the different material phase directions jointly support relevant deformation. For example, when considering a woven PCD composite composition of this invention, the strength enhancing effect of the continuous material phases makes spalling and chipping of the structure less probable as contrasted to conventional PCD materials.

While specific woven composite construction embodiments have been described and illustrated, it is to be understood that woven composite constructions of this invention can have unlimited geometrical and physical configurations. The physical properties of woven composite constructions of this invention can be controlled and changed by selecting different combinations of geometry and patterns, much like woven textiles and fabrics. For example, each material phase or strip used to form woven composite compositions of this invention can be formed from numerous integrations of thinner strips or films.

Woven composite constructions of this invention are formed by first preparing one or more suitable material phases described above. In an example embodiment, a first material phase in the form of a tape is prepared by combining synthetic diamond powder with a binder material, e.g., cobalt, and an organic binder, and forming the combined mixture into a desired sheet or web. The sheet or web can either be formed in the desired material phase strip width or can be cut into the desired strip width. A second material phase also in the form of a tape is prepared by combining a powder of a relatively more ductile material, such as those cermets and metal materials discussed above, with an organic binder. The second material phase is also either formed in the desired strip width or is cut into the desired strip width.

The first and second so-formed material phases are woven together by conventional means, e.g., by hand or by machine process, to form a green woven composite construction. The green woven composite construction can either be formed in the desired final shape initially, or can be cut into the desired final shape by convention means, for application with a designated substrate. The green part was thermally debinded and sintered by high-temperature, high-pressure process.

Woven composite constructions of this invention are better understood with reference to the following example.

Example—Woven Composite Construction

A preferred woven composite construction of this invention, comprising a first material phase of PCD-/Co and a second material phase of WC—Co, can be prepared by weaving together strips of diamond tape and WC/Co tape. The diamond tape is prepared in the manner discussed above comprising synthetic diamond powder, cobalt and an organic binder. The diamond tape was available from Mega-Diamond of Provo, Utah. The pre-cemented tungsten carbide tape can be prepared from WC—Co powder taken from TCM grades 411, 510, 614, or 616, available from Kennametal of Latrobe, Pa., and an organic binder.

The diamond and WC/Co tapes are each cut into desired width strips for weaving into the composite construction. In a preferred embodiment, the diamond and WC/Co strips forming the first and second material phases, respectively, each had a thickness and width in the range of from 0.005 inches to 0.020 inches. The length of each strip is understood to vary depended on the size of the final composite construction or the desired size of the working "sheet" of woven material.

The strips can be woven together by hand or by machine process to provide a composite microstructure having a woven design arrangement with repeating first and second material phases, as illustrated in FIGS. 1 and 2. The woven composite construction is then formed into a green part having either a planar or nonplaner shape to facilitate placement onto a complementary substrate surface, and was thermally debinded at a temperature in the range of from about 200 to 400° C. The thermally debinded green part is then sintered by high-temperature, high-pressure process at approximately 1,400° C. and approximately 55 megapascals for approximately 120 seconds to form a composite construction having a woven structure of PCD and WC—Co.

Figure 3A:
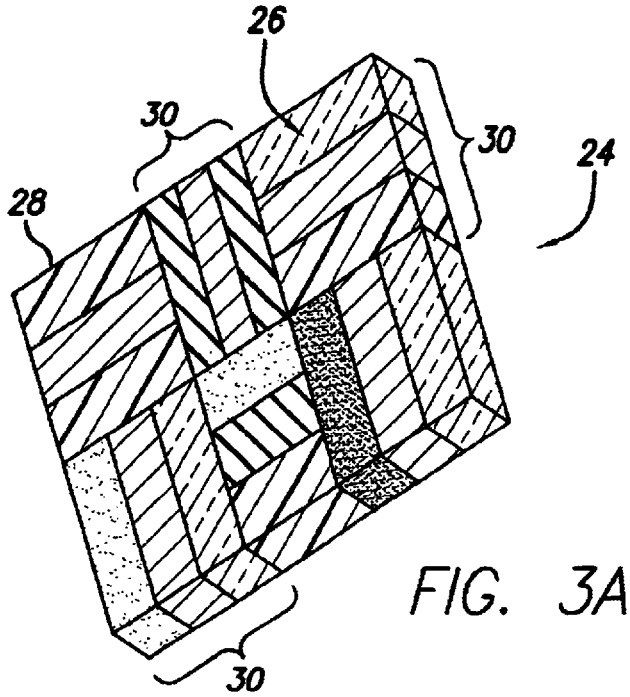
FIGS. 3A to 3C are schematic views of example packed composite constructions of this invention.
Figure 3B:
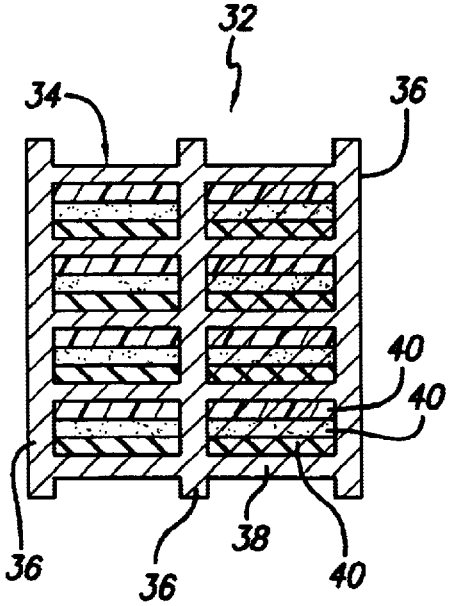
Figure 3C:
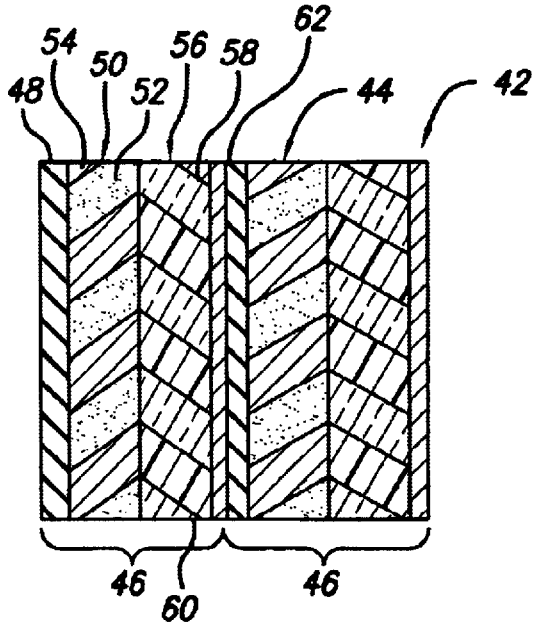

FIGS. 3A to 3C illustrate second example composite constructions of this invention each comprising a macrostructure or a microstructure that is generally made up of two or more packed material phases. FIG. 3A illustrates packed composite construction 24 having a structure 26 comprising a number of different material phases 28 that are positioned side-by-side one another. Each of the material phase 28 is generally in the form of a rectangle extending parallel or perpendicular to adjacent material phases. The material phases 28 can be formed from the same or different type of material, selected from the groups of materials discussed above for the woven composite construction embodiment.

Material phases used to form packed composite constructions of this invention can have different geometric shapes, e.g., rectangular, square, hexagonal and the like, and can be arranged differently to provide a desired microstructure pattern and/or macrostructure pattern as set forth in U.S. patent application Ser. No. 09/521,717 filed on Mar. 9, 2000, which is incorporated herein by reference.

Referring to FIG. 3A, the structure comprises an arrangement of structural units 30 that each include two or more material phases 28 that are positioned in parallel with one another. The structural units are arranged within the microstructure so that adjacent structural units include material phases arranged perpendicular to one another. The material phases within each structural phase are formed from the same or different types of materials depending on the particular application.

FIG. 3B illustrates another composite construction 32 of this invention comprising a packed structure 34 made up of a continuous first material phase 36 and second material phase sections 38 disposed within the first material phase. The second material phase 38 is formed from multiple bands 40 of materials. The first and second material phases can be formed from the same types of materials disclosed above for forming the woven composite constructions of this invention.

FIG. 3C illustrates a still other composite construction 42 of this invention comprising a packed structure 44 made up of several different material phases. Generally speaking, the composite construction 42 comprises structural units 46 that are positioned adjacent one another. The structural units are each comprise a first material phase 48 in the shape of a rectangle, a second material phase 50 positioned adjacent the first material phase comprising repeating diagonal first and second regions 52 and 54, a third material phase 56 positioned adjacent the second material phase comprising repeating diagonal first and second regions 58 and 60, and a fourth material phase 62 positioned adjacent the third material phase-in the shape of a rectangle.

While packed composite constructions of this invention have been described and illustrated having particular structures comprising specific structural units and/or material phases. It is to be understood that such structures are intended to be only representative of the many different packed microstructure and macrostructure arrangements that can be created according to the principles of this invention. Thus, packed composite constructions having structures other than those specifically described and illustrated are intended to be within the scope of this invention.

Referring to FIG. 4, packed composite structures of this invention are constructed from one or more laminate constructions 64 each comprising one or more material layers 66 to 76. In the example embodiment illustrated, a laminate construction 64 used to form packed composite structures of this invention comprises an arrangement of material layers 66 to 76, each formed from the same or different materials. The types of materials selected to form the material layers, the order of material layer arrangement, and the number of material layers are all defined by the particular composite construction application, as the material layers ultimately form the composite structure.

Suitable types of materials used to form materials layers in the laminate includes the same types of material as those discussed above for forming the material phases in the woven composite Construction. For example, a laminate construction 64 can comprises material layers formed from synthetic diamond powder, cubic boron nitride powder, a cermet powder, a ductile metal powder, and mixtures thereof. For example, composite constructions useful for forming working surfaces of subterranean drilling and/or cutting machinery preferably have a packed structure comprising one or more material phases made of hard materials, e.g., PCD, and one or more material phases made of a relatively more ductile material, e.g., WC—Co. A composite construction comprising a packed structure of PCD material phases and WC—Co material phases provide improved properties of fracture toughness, impact resistance, and/or fatigue life when compared to conventional PCD materials.

Figure 5:
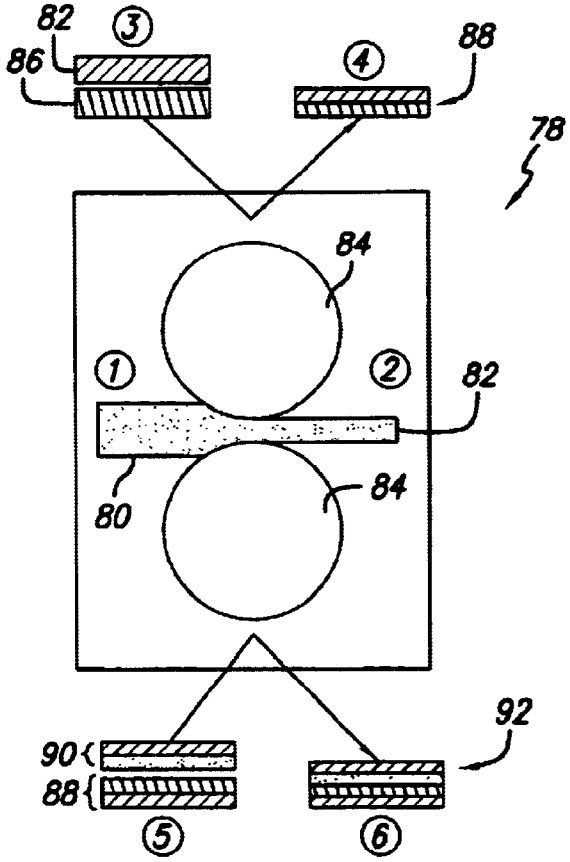
FIG. 5 is a schematic illustration of a rolling process for making laminate constructions useful for forming packed composite constructions of this invention.

FIG. 5 illustrates a method 78 for making laminate constructions for use in forming packed composite constructions of this invention. The laminate construction can be in the form of a noncontinuous sheet or a continuous web, and can have a variable thickness and width depending on process limitations and/or final application requirements. A thick film 80 is processed into a thinner film 82 of desired thickness by process of running the thick film 80 through a pair of rollers 84. The starting and ending thickness' will generally be determined by the number of layers and the final diamond table thickness desired on the finished product.

The process of creating a thin film from a relatively thicker film is repeated to create a multi-material layer laminate construction. For example, the thinner film 82 produced above is combined with another thin film 86 formed from a different material and is run through the rollers 84 to produce a thin-film laminate construction 88 comprising two material layers. Multi-material layer laminate constructions 92, useful for forming packed composite constructions of this invention, are prepared by combining the thin-film laminate construction 88 produced above with another thin-film laminate construction 90, which can be formed from the same or different materials as that used to form the thin-film laminate construction 88, and passing the two thin-film laminate constructions through the rollers 84. The process of combining and rolling can be repeated over and over again until a multi-material layer thin film laminate construction having the desired arrangement of material layers is achieved.

Figure 6:
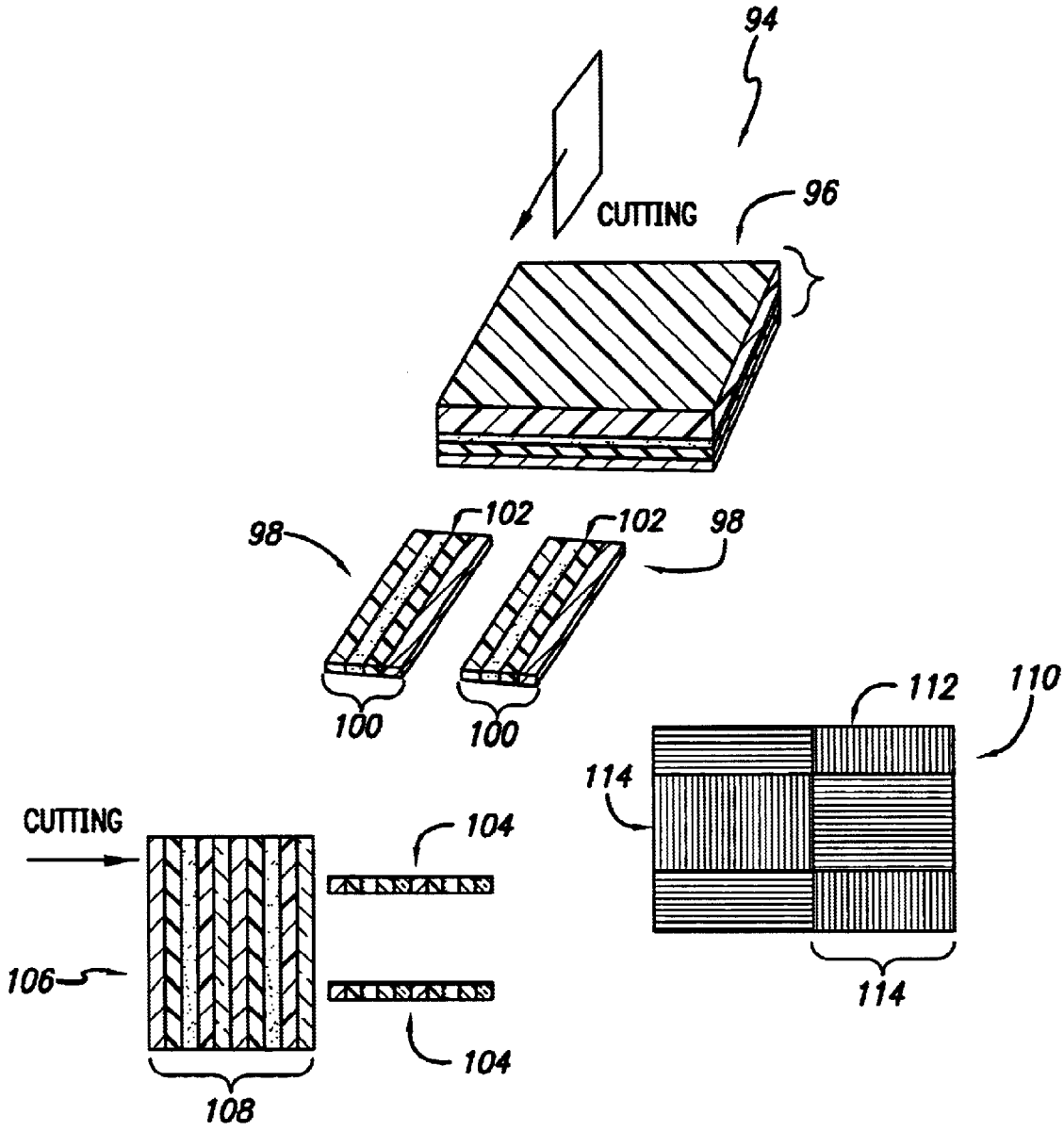
FIG. 6 is a schematic illustration of a cutting process for making laminate slices useful for forming packed composite constructions of this invention.
Figure 7:
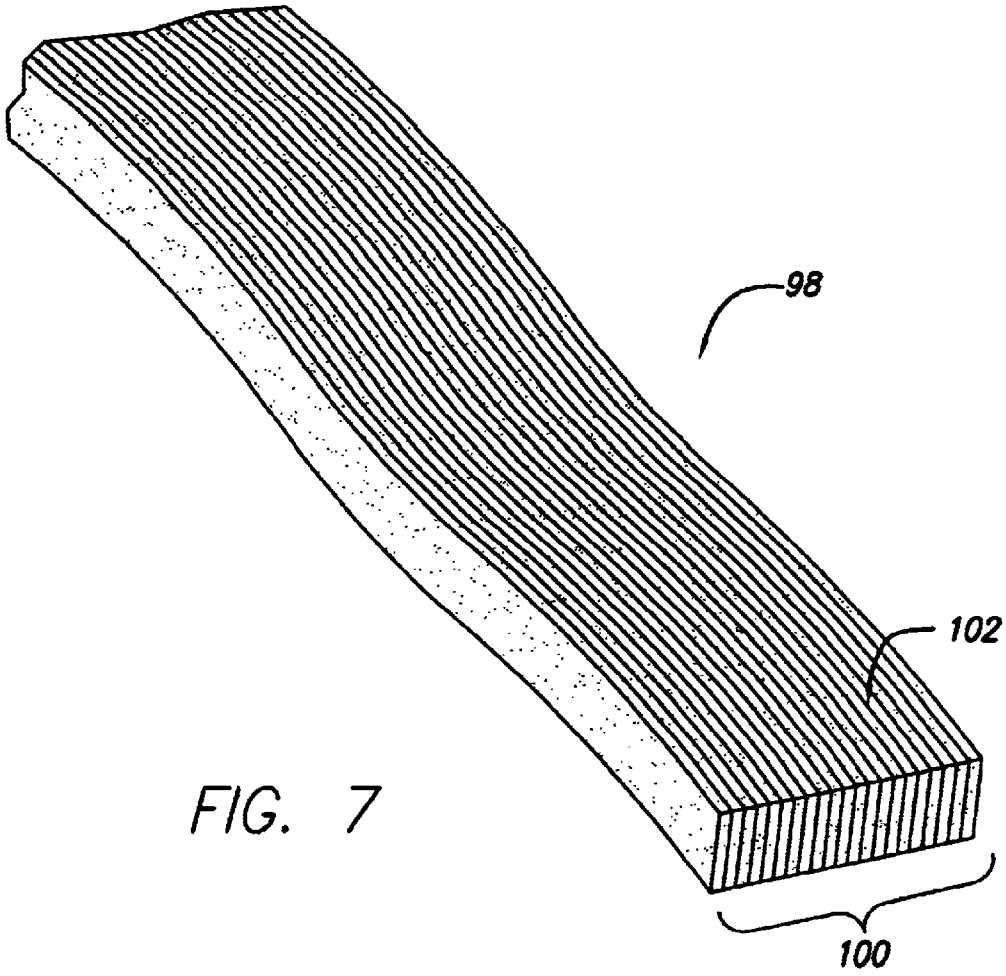
FIG. 7 is an enlarged view of an example slice from a laminate construction useful for forming packed composite constructions of this invention.

FIG. 6 illustrates a method 94 for making packed composite constructions of this invention comprising cutting the multi-layer laminate sheet 96, prepared in the manner described above and illustrated in FIG. 5, into one or more laminate slices 98. The laminate slices 98 are laid down so that the material layers 100 forming the same are exposed to form a slice surface 102. FIG. 7 illustrates a further example of a laminate slice 98, formed according to the above described method, comprising multiple material layers 100 that are exposed along a slice surface 102. As illustrated in FIGS. 6 and 7, the surfaces 102 of the laminate slices 98 may comprise any number of material layers, formed from any number of different materials, depending on the material construction of the multi-layer laminate sheet.

Referring back to FIG. 6, after the laminate sheet has been cut into laminate slices 98, the slices can be combined within one another, or can be combined with slices from other laminate sheets, to form a compounded slice construction 104 that can be used to form the packed composite construction of this invention. Alternatively, rather than performing the steps of cutting and combining to achieve the desired compounded slice construction, compounded slice constructions 104 can be formed without the combining step by cutting a laminate construction 106 already formed from the desired material layers 108.

The above-described and illustrated compounded slice constructions 106 can be used to form packed composite constructions 110 of this invention having a packed structure 112 of one or more material phases 114 made up of multiple material layers. It is to be understood that the multiple material layers can each be formed from a single-type of material, or can be formed from two or more materials, itself having a structure. Thus, packed composite constructions, comprising such material layers, can be thought of as having a microstructure within a macrostructure.

The above-described and illustrated method is understood to be representative of but one way of making packed composite constructions of this invention. It is to be understood that methods of cutting and combining other than those specifically described and illustrated above are intended to be within the scope of this invention.

Packed composite constructions of this invention are better understood with reference to the following example.

Example—Packed Composite Construction

A preferred embodiment of a packed composite construction of this invention comprises a first material phase of PCD—Co, surrounded by a second material phase of WC—Co, and is prepared by the method of cutting and combining described above. The slices were arranged and packed together by hand or by machine process to provide an elongated packed composite structure of which a "slice" of desired diamond table thickness, accounting for material shrinkage, is cut off. The packed composite construction slice or wafer is then formed into a green part having either a planar or nonplaner shape to facilitate placement onto a complementary substrate surface, and is thermally debinded at a temperature in the range of from about 200 to 400° C. The thermally debinded green part is sintered by high-temperature, high-pressure process at approximately 1,400° C. and approximately 55 megapascals for approximately 120 seconds to form a composite construction having a packed structure of PCD—Co and WC—Co.

Woven and packed composite constructions of this invention may, while in the form of a green part, have an undesired degree of porosity within one or more material phases. In many instances, such porosity can be cured during the process steps of debinding, sintering, and pressing the green parts. In the event that the green part comprises porosity that will not likely be cured during subsequent debinding, sintering, and pressing process, the green part can be treated by a pressure process. For example, woven and packed composite constructions of this invention may be treated by pressure process, before the step of sintering, by loading the construction within a mold and subjecting the construction to pressure by use of a press. The pressure imposed onto the green part by the press causes the material phases that make up the composite construction to undergo a controlled amount of flow that serves to fill and cure composite construction porosity.

Composite constructions of this invention, comprising woven and packed PCD containing controlled structures, display improved physical properties of fracture toughness, impact resistance, fatigue life and/or chipping resistance, without sacrificing wear resistance, when compared to conventional pure PCD materials. This result is due to the special architecture of the structure, comprising a woven or packed arrangement of one or more PCD material phase with one or more relatively more ductile material phase. The PCD material phases act to control the wear rate of the composite while the ductile material phases provide properties of toughness and impact resistance via crack blunting and crack interruption, due to the ability to absorb impact energy.

Woven and packed composite constructions of this invention can be used in a number of different applications, such as tools for mining, cutting, machining and construction applications, where the combined mechanical properties of high fracture toughness, impact resistance, fatigue life, wear resistance, and/or hardness are highly desired. Composite constructions of this invention can be used to form wear and cutting components in machine tools and drill and mining bits such as roller cone rock bits, percussion or hammer bits, diamond bits, and substrates for shear cutters.

Figure 8:
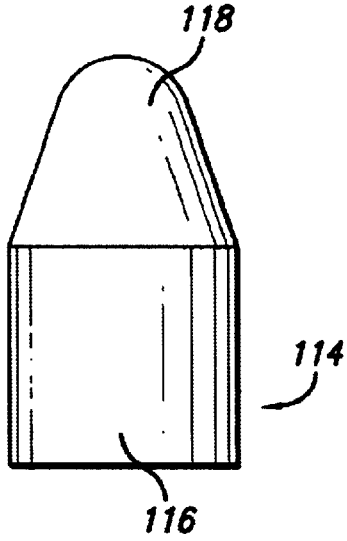
FIG. 8 is a perspective side view of an insert for use in a roller cone or a hammer drill bit comprising a PCD composite construction of this invention.

FIG. 8 illustrates an insert 114 for use in a wear or cutting application in a roller cone drill bit or percussion or hammer drill bit may be formed from woven or packed composite constructions of this invention. An example insert 114 comprises a substrate blank 116 made from tungsten carbide and formed into the general shape of a roller cone rock bit insert, and a working surface 118 disposed over a surface portion of the insert formed from a woven or packed composite construction of this invention. After a green woven or packed composite construction is placed over the insert substrate surface, the green part is heated to about 200 to 400° C. in vacuum or flowing inert gas to debind the composite, and the debinded composite is then sintered. Depending on the particular material make up of the composite construction, sintering can take place within a temperature range of from about 1280 to 1450° C.

Other consolidation techniques well known in the art may be used during the manufacture of composite constructions of this invention, including normal liquid phase sintering, hot pressing, and hot isostatic pressing (HIPing) as described in U.S. Pat. No. 5,290,507, that is incorporated herein by reference, and rapid omnidirectional compaction (ROC) as described in U.S. Pat. Nos. 4,945,073; 4,744,943; 4,656,002; 4,428,906; 4,341,577 and 4,124,888 that are each incorporated herein by reference.

Figure 9:
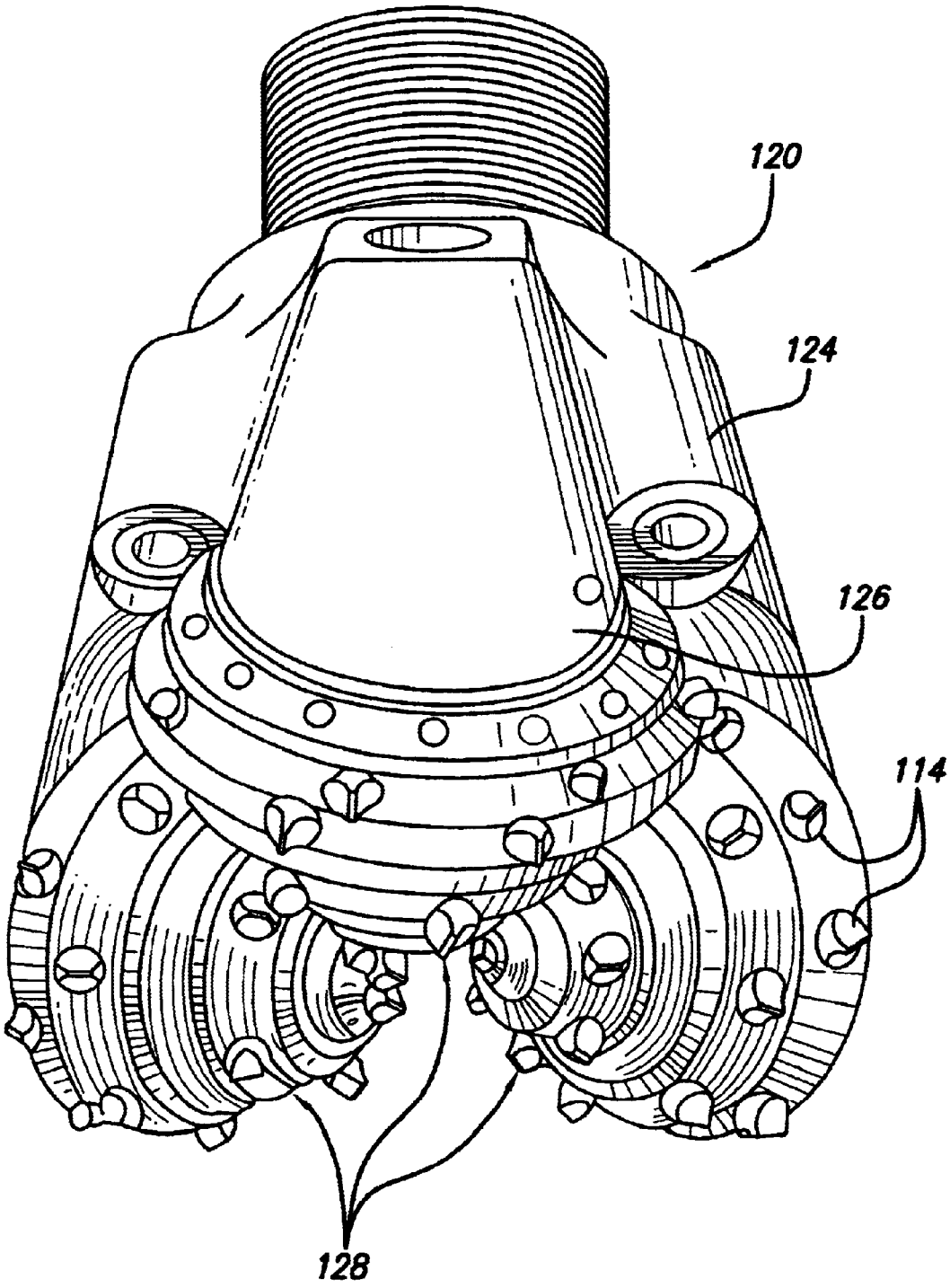
FIG. 9 is a perspective side view of a roller cone drill bit comprising a number of the inserts of FIG. 8.

FIG. 9 illustrates a roller cone rock bit 120 comprising a number of the inserts 114 described above and illustrated in FIG. 8. The rock bit 120 comprises a body 124 having three legs 126, and a roller cutter cone 128 mounted on a lower end of each leg. The inserts 114 comprise a surface formed from woven and or packed composite constructions of this invention. In specific applications, the extension portion or the whole insert can be formed from the woven or packed composite construction of this invention. The inserts 114 are provided along one or more surfaces of each cutter cone 128 for bearing on a rock formation being drilled.

Figure 10:
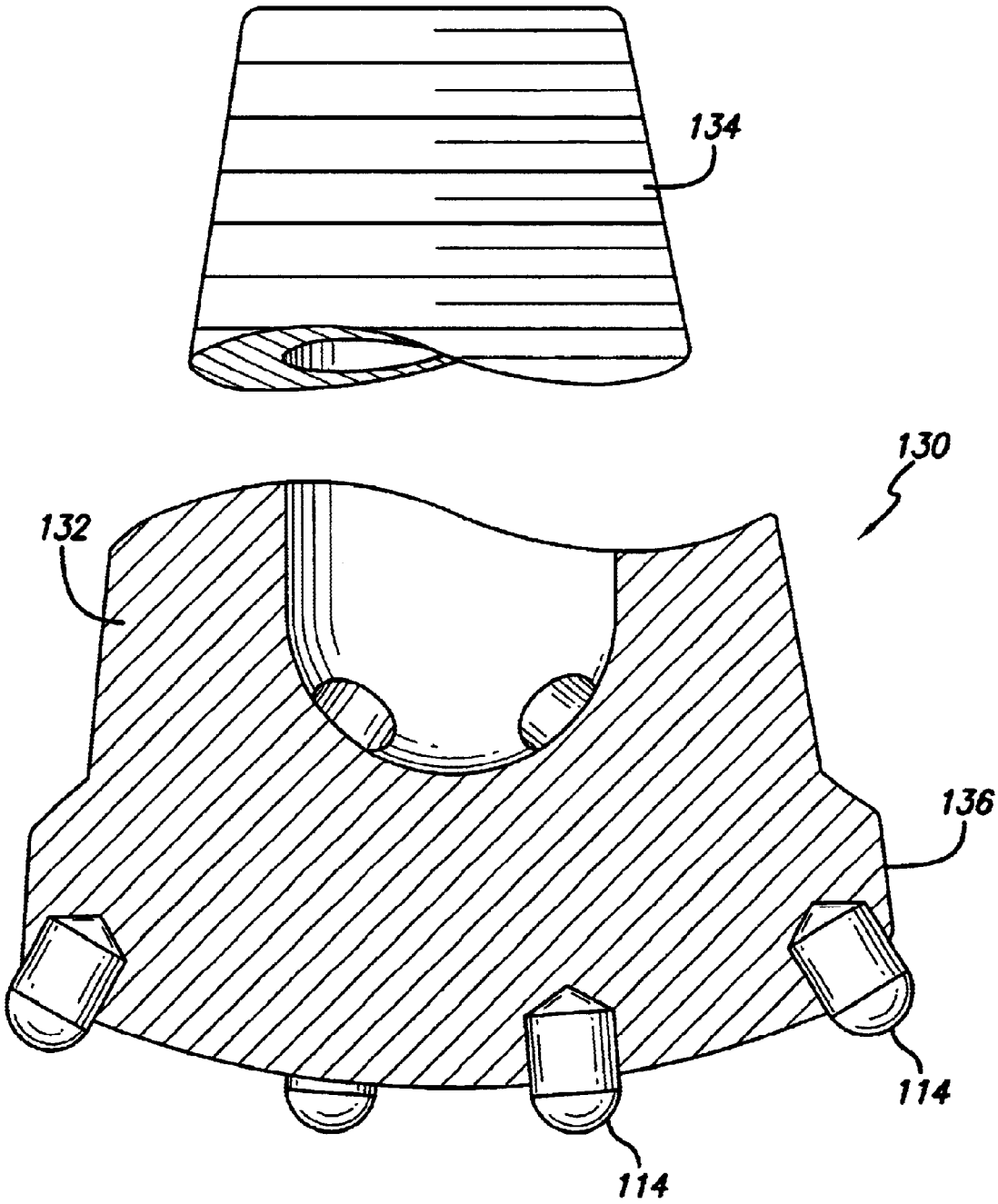
FIG. 10 is a perspective side view of a percussion or hammer bit comprising a number of inserts of FIG. 8.

FIG. 10 illustrates a percussion or a hammer bit 130 comprising one or more inserts 114 having a woven or packed composite construction of this invention. The percussion or hammer bit 130 comprises a hollow steel body 132 having a threaded pin 134 on an end of the body for assembling the bit onto a drill string (not shown) for drilling oil wells and the like. A plurality of the inserts 114 are provided in the surface of a head 136 of the body 132 for bearing on a subterranean formation being drilled.

FIG. 11 illustrates a shear cutter 136 that is used, for example, with a drag bit for drilling subterranean formations. The shear cutter 136 comprises a cutting surface comprising a woven or packed composite construction of this invention. More specifically, composite constructions of this invention can be used to either form a shear cutter substrate 138 or the shear cutter working surface 140.

FIG. 12 illustrates a drag bit 140 comprising a plurality of the shear cutters 136 described above and illustrated in FIG. 11. The shear cutters 136 are each attached to blades 142 that extend from a head 144 of the drag bit for cutting against a subterranean formation being drilled.

Although, limited embodiments of composite constructions having woven and packed structures, methods of making the same, and applications for the same, have been described and illustrated herein, many modifications and variations will be apparent to those skilled in the art. For example, although composite constructions have been described and illustrated for use with rock bits, hammer bits and drag bits, it is to be understood that composites constructions of this invention are intended to be used with other types of mining, cutting and construction tools. Accordingly, it is to be understood that within the scope of the appended claims, composite constructions according to principles of this invention may be embodied other than as specifically described herein.

What is claimed is:

1. A composite construction comprising:

a structure of two or more different material phases that are woven together;

wherein at least one of the material phases comprises a hard material selected from the group consisting of: polycrystalline diamond, polycrystalline cubic boron nitride; carbides, borides, nitrides, and carbonitrides from groups IVA, VA, and VIA of the Periodic Table; and mixtures thereof.

2. The composite construction as recited in claim 1 wherein another of the material phases comprises a material having a degree of ductility that is higher than that of the material phase formed from a hard material.

3. The composite construction as recited in claim 1 wherein one of the material phases is formed from a material selected from the group consisting of cermets, Co, Ni, Fe, W, Mo, Cu, Al, Nb, Ti, Ta, and mixtures thereof.

4. The composite construction as recited in claim 1 wherein the structure comprises two material phases, wherein a first material phase is selected from the group consisting of carbides, borides, nitrides, and carbonitrides from groups IVA, VA, and VIA of the Periodic Table, and a second material phase is selected from the group consisting of Co, Ni, Fe, W, Mo, Cu, Al, Nb, Ti, Ta, and mixtures thereof.

5. The composite construction as recited in claim 4 wherein the first material phase is WC—Co, and the second material phase is Co.

6. The composite construction as recited in claim 1 wherein the structure comprises two material phases, wherein a first material phase is selected from the group consisting of polycrystalline diamond, polycrystalline cubic boron nitride, and mixtures thereof, and a second material phase is a cermet material.

7. The composite construction as recited in claim 6 wherein the first material phase is polycrystalline diamond and the second material phase is WC—Co.

8. The composite construction as recited in claim 1 wherein the material phases are each in the form of a substantially continuous band, and wherein the structure comprises a number of the bands that are woven together with one another.

9. The composite construction as recited in claim 8 wherein the structure comprises-sections where the first and second material bands are layered over one another.

10. The composite construction as recited in claim 1 wherein at least one of the material phases comprises more than one type of material.

11. The composite construction as recited in claim 1 wherein two of the material phases comprise polycrystalline diamond.

12. The composite construction as recited in claim 1 wherein a first material phase is polycrystalline diamond, and a second material phase is polycrystalline diamond.

13. A composite construction comprising:

a structure of two or more material phases that are woven together;

wherein the material phases are in the form of a substantially continuous band formed from materials selected from the group consisting of: polycrystalline diamond, polycrystalline cubic boron nitride; carbides, borides, nitrides, carbonitrides from groups IVA, VA, and VIA of the Periodic Table; cermets, Co, Ni, Fe, W, Mo, Cu, Al, Nb, Ti, Ta; and mixtures thereof.

14. The composite construction as recited in claim 13 comprising a first material phase and a second material phase, wherein the second material phase is formed from a material having a degree of ductility that is higher than the material selected to form the first material phase.

15. The composite construction as recited in claim 13 wherein the ordered structure comprises an arrangement of a first or second material phase that is surrounded on four sides by the other of the first or second material phases.

16. The composite construction as recited in claim 13 wherein the structure comprises sections where the material phase bands are layered over one another.

17. The composite construction as recited in claim 13 wherein a first material phase is WC—Co, and a second material phase is Co.

18. The composite construction as recited in claim 13 wherein a first material phase is selected from the group consisting of polycrystalline diamond, polycrystalline cubic boron nitride, and mixtures thereof, and a second material phase is a cermet material.

19. The composite construction as recited in claim 18 wherein the first material phase is polycrystalline diamond and the second material phase is WC—Co.

20. The composite construction as recited in claim 13 wherein at least one of material phases is a multi-layer construction.

21. The composite construction as recited in claim 13 wherein at least one of the material phases is formed from more than one material.

22. The composite construction as recited in claim 13 wherein at least one of the material phases has a structure comprising two or more material regions.

23. A composite construction comprising:

an ordered structure of two or more material phases;

wherein a first material phase is in the form of a substantially continuous band comprising polycrystalline diamond; and wherein the second material phase is in the form of a substantially continuous band formed from a material selected from the group consisting of cermets, Co, Ni, Fe, W, Mo, Cu, Al, Nb, Ti, Ta, and mixtures thereof, the first and second material phases being interwoven with one another to provide a repeating arrangement of first and second material phases.

24. A roller cone drill bit comprising:

a body having a number of legs that extend therefrom;

cutting cones rotatably disposed on an end of each leg;

a plurality of cutting inserts disposed in the cutting cones, therein at least a portion of the cutting inserts are formed from a composite construction having a structure of two or more material phases that are woven together;

wherein the material phases include materials selected from the group consisting of polycrystalline diamond, polycrystalline cubic boron nitride; carbides, borides, nitrides, and carbonitrides from groups IVA, VA, and VIA of the Periodic Table, Co, Ni, Fe, W, Mo, Cu, Al, Nb, Ti, Ta, and mixtures thereof.

25. The drill bit as recited in claim 24 wherein the composite construction structure comprises a first material phase formed from WC—Co, and a second material phase formed from Co.

26. The drill bit as recited in claim 24 wherein the structure comprises two material phases, wherein a first material phase is selected from the group consisting of polycrystalline diamond, polycrystalline cubic boron nitride, and mixtures thereof, and a second material phase is a cermet material.

27. The drill bit as recited in claim 26 wherein the first material phase is polycrystalline diamond and the second material phase is WC—Co.

28. A drag drill bit comprising:

a body having a head and having a number of blades extending away from a head surface, the blades being adapted to engage a subterranean formation during drilling;

a plurality of shear cutters disposed in the blades to contact the subterranean formation during drilling, each shear cutter comprising a substrate and a layer of cutting material disposed thereof, the cutting material comprising a composite construction having a structure of two or more material phases that are woven together;

wherein the material phases include materials selected from the group consisting of polycrystalline diamond, polycrystalline cubic boron nitride; carbides, borides, nitrides, and carbonitrides from groups IVA, VA, and VIA of the Periodic Table, Co, Ni, Fe, W, Mo, Cu, Al, Nb, Ti, Ta, and mixtures thereof.

29. The drill bit as recited in claim 28 wherein the composite construction structure comprises a first material phase formed from WC—Co, and a second material phase formed from Co.

30. The drill bit as recited in claim 28 wherein the structure comprises two material phases, wherein a first material phase is selected from the group consisting of polycrystalline diamond, polycrystalline cubic boron nitride, and mixtures thereof, and a second material phase is a cermet material.

31. The drill bit as recited in claim 30 wherein the first material phase is polycrystalline diamond and the second material phase is WC—Co.

* * * * *